US006019224A

United States Patent [19]

Rich

[11] Patent Number: 6,019,224

[45] Date of Patent: Feb. 1, 2000

[54] TACO SHELL SUPPORT DEVICE

[76] Inventor: Lazell C. Rich, 4818 Spaulding, Omaha, Nebr. 68104

[21] Appl. No.: 09/280,151

[22] Filed: Mar. 26, 1999

[51] Int. Cl.[7] ..... B65D 5/00

[52] U.S. Cl. ..... 206/546; 206/562; 229/904; 426/110

[58] Field of Search ..... 229/902, 903, 229/904; 206/541, 546, 1.5, 557, 562; 426/110, 112

[56] References Cited

U.S. PATENT DOCUMENTS

| | | | |
|---|---|---|---|
| 4,705,173 | 11/1987 | Forbes, Jr. | 229/904 X |
| 5,123,527 | 6/1992 | Hustad | 229/902 X |
| 5,203,493 | 4/1993 | Moody | 229/904 X |
| 5,765,690 | 6/1998 | Baxter | 206/1.5 |

*Primary Examiner*—Jacob K. Ackun

[57] ABSTRACT

A taco shell support device includes a collapsible, generally rectangular box having a base wall, opposite first and second walls hingedly mounted on the base wall and a top wall hingedly connected to one of the first and second walls so that the box is expandable from a generally flat storage position to an upright taco shell support position wherein the top wall is positioned above the base wall with the first and second walls spacing the top wall from the base wall, the box including at least one taco-receiving slot formed in the top wall for receiving and supporting a taco shell and a flap having flap securement means mounted thereon, the flap foldably connected to one of the base and top walls, the flap securement means operative to secure the flap to one of the first and second walls thereby securing the box in the upright taco shell support position.

11 Claims, 4 Drawing Sheets

FIG. 2

TACO SHELL SUPPORT DEVICE

BACKGROUND OF THE INVENTION

1. Technical Field

The present invention relates to taco shell holders and, more particularly, to a taco shell support device including a collapsible, generally rectangular box having a base wall, opposite first and second walls hingedly mounted on the base wall and a top wall hingedly connected to one of the first and second walls so that the box is expandable from a generally flat storage position to an upright taco shell support position wherein the top wall is positioned above the base wall with the first and second walls spacing the top wall from the base wall, the box including at least one slot formed in the top wall for receiving and supporting a taco shell and a flap having at least one tab foldably connected thereto, the flap being foldably connected to one of said base and top walls and the tab operative to extend through and be secured in a tab-receiving slot formed between the top and base walls in one of the first and second walls thereby securing the box in the upright taco shell support position.

2. Description of the Prior Art

Mexican food, particularly tacos, has become one of the most popular types of food served in the United States. The Mexican foods market, including fast food branches such as Taco Bell and Taco John's and foods for home consumption manufactured by such companies as Old El Paso and Pace, constitute multi-billion dollar business. Of course, while many individuals enjoy the fast food type of Mexican food, many others prefer to construct their tacos at home using fresh ingredients to make their tacos. A problem encountered in the home manufacture of tacos, however, is that as taco shells have a rounded base, it requires some degree of manual dexterity to support the taco shell in an upright position while filling the taco shell with beef, bean, vegetables, and/or salsa, depending upon the individual tastes of the taco builder. The likely result of such endeavor is the making of a mess wherein many of the taco ingredients end up outside the taco shell during the construction process. There is therefore a need for a taco shell support device which will support the taco shell in an upright position to simplify the taco shell filling process.

It has also been found to be preferable to present prepared food in an aesthetically pleasing format. In Mexican restaurants, the tacos are often brought to the table on their side on a plate, which can lead to much of the taco filling falling out of the taco shell onto the plate, necessitating action by the food consumer to replace the taco fillings in the taco shell. It may be preferable to serve the tacos in an upright position to prevent the taco fillings from falling out of the taco shell and, therefore, there is a need for a device which will permit the serving of the tacos in an upright position, which will be aesthetically pleasing.

Also, the home consumer of tacos will want to enjoy the benefits of any such taco shell holding device, but if the packaging of the holder and the taco shells is ungainly, unsightly or simply bulky, the consumer will not purchase the shells and device. There is therefore a need for a taco shell holder which is collapsible to a generally flat storage position yet, after unpackaging, is quickly and easily expandable to a taco shell holding position which will not readily collapse during the taco shell filling process.

Finally, it is common for the taco shells to be prepared in an ordinary manner by heating the shells on their sides on a baking sheet. However, one major problem encountered in this type of preparation is that the taco shells often close during the cooking, thus rendering them unsuitable for use for tacos. If the taco shells were supported in an upright position during the baking process, the percentage of usable shells would be greatly increased. Furthermore, once the cooking process is completed, if the taco shells were supported on such an ovenable support device, the tacos could be filled and prepared on the device, substantially eliminating the dangers inherent in removing recently heated taco shells from a baking tray, such as burns and the like. There is therefore a need for a taco shell support device which is ovenable.

Therefore, an object of the present invention is to provide an improved taco shell support device.

Another object of the present invention is to provide a taco shell support device which includes a collapsible, generally rectangular box having a base wall, front and rear walls hingedly mounted on opposite sides of the base wall and extending upwards therefrom, and a top wall hingedly connected to the front and rear walls above the base wall so that the box is expandable from a generally flat storage position to an upright taco shell support position, the top wall of the box including at least one slot for receiving and supporting a taco shell in an upright position.

Another object of the present invention is to provide a taco shell support device which also includes at least two tabs foldably connected to and extending from at least one of the front, rear and base walls, the tabs operative to fold to extend between the top and base walls when the box is in the upright taco shell support position to secure the box in the upright taco shell support position.

Another object of the present invention is to provide a taco shell support device which is collapsible to a generally flat storage position to permit the efficient, economical storage of the taco shell support device when it is not being used.

Another object of the present invention is to provide a taco shell support device which is constructed of a plastic coated or impregnated paper to enable use of the taco shell support device even if wet material is spilled on the device yet permit easy and environmentally safe disposal of the support device upon completion of use.

Another object of the present invention is to provide a taco shell support device which is capable of supporting shells in the oven during the cooking process and can then be used for support during the filling process.

Finally, an object of the present invention is to provide taco shell support device which is relatively simple to manufacture, safe and efficient in use and ecologically safe for disposable.

SUMMARY OF THE INVENTION

The present invention provides a taco shell support device including a collapsible, generally rectangular box having a base wall, opposite first and second walls hingedly mounted on the base wall and a top wall hingedly connected to one of the first and second walls so that the box is expandable from a generally flat storage position to an upright taco shell support position wherein the top wall is positioned above the base wall with the first and second walls spacing the top wall from the base wall, the box including at least one slot formed in the top wall for receiving and supporting a taco shell and a flap having at least one tab foldably connected thereto, the flap being foldably connected to one of the base and top walls and the tab operative to extend through and be secured in a tab-receiving slot formed between the top and base walls in one of the first and second walls thereby securing the box in the upright taco shell support position.

The taco shell support device of the present invention provides numerous advantages over those devices found in the prior art. First, because the device is collapsible to a generally flat storage position, it is possible to include the present invention in a taco shell box such as the kind commonly sold in supermarkets. Second, the plurality of slots in the holder permit the making of multiple tacos simultaneously, a boon for persons such as mothers who are making tacos for an entire family. Also, the present invention may include a placard mounted on the rear wall which can be printed with advertising, a useful feature for fast food chains. It is thus believed that the present invention provides a substantial improvement over the prior art.

DESCRIPTION OF THE PREFERRED EMBODIMENTS

Figure 1:
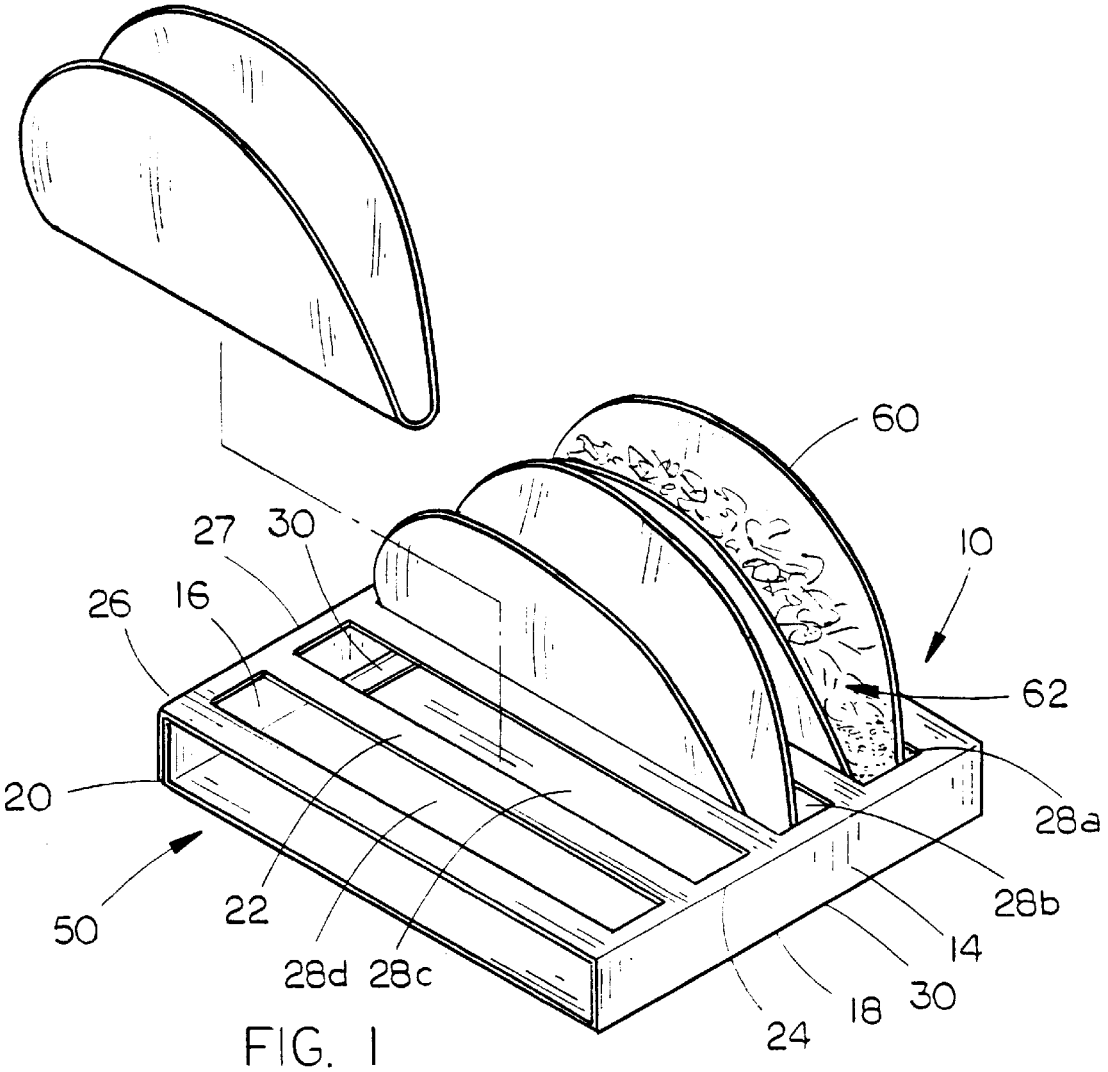
FIG. 1 is a perspective view of the taco shell support device of the present invention with tacos being made therein.
Figure 4:
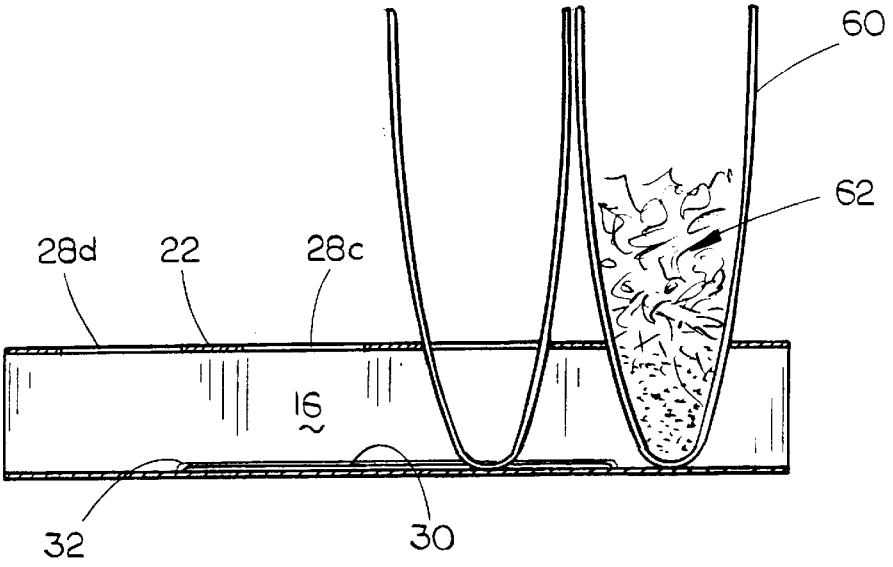
FIG. 4 is a detailed end elevational cutaway view of the present invention showing how taco shells are supported therein.
Figure 5:
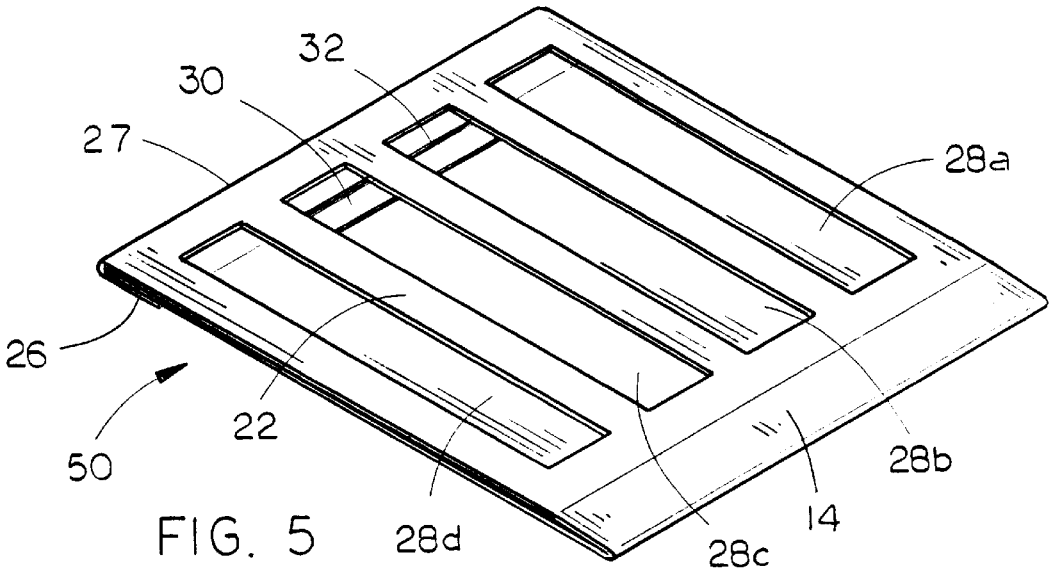
FIG. 5 is a perspective view of the present invention showing the box in collapsed, generally flat storage position.

The taco shell support device 10 of the present invention is shown best in FIGS. 1–4 as including a base wall 12 which is generally rectangular in shape and a first wall 14 and second wall 16 each hingedly connected to base wall 12 at opposite edges thereof and extending upwards from base wall 12 as shown in FIG. 1. In the preferred embodiment, the hinged connection between the first wall 14 and base wall 12 and second wall 16 and base wall 12 would simply be a fold formed in the construction material of the taco shell support device 10. One hinged fold 18 would connect base wall 12 and first wall 14 and the other hinged fold 20 would connect second wall 16 and base wall 12 thus permitting the first and second walls 14 and 16 to be pivoted from a position generally perpendicular to base wall 12 to a position generally parallel to base wall 12 as shown in FIG. 5.

Figure 2:
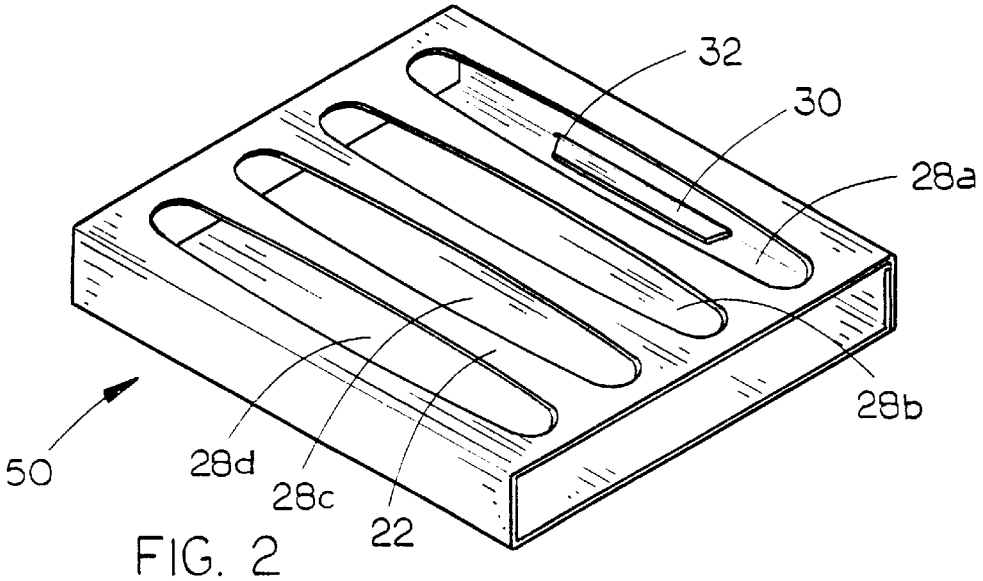
FIG. 2 is a perspective view of the taco shell support device of the present invention.
Figure 3:
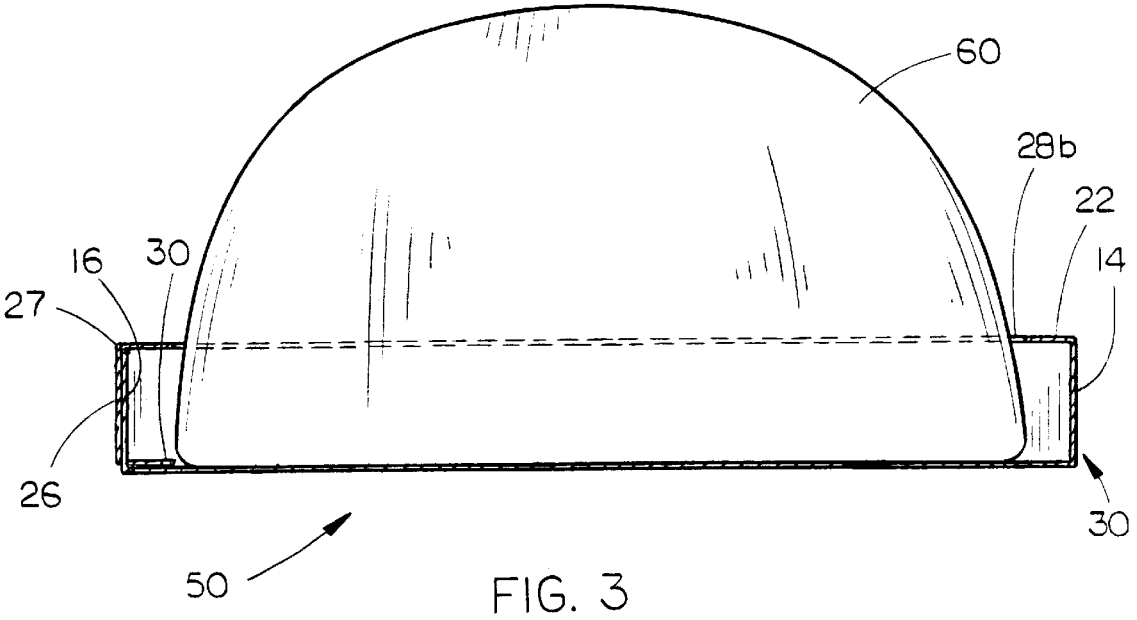
FIG. 3 is a detailed side elevational view of the taco shell support device showing how the taco shell would fit into the shell support device.

Extending between and hingedly connected to at least one of the first and second walls 14 and 16 above base wall 12 is a top wall 22 shown best in FIGS. 1 and 2, which, in the preferred embodiment is hingedly connected to first wall 14 by hinged fold 24. Top wall 22 thus completes the generally rectangularly box structure 50 of the device 10 of the present invention with the generally rectangular box 50 having approximate dimensions of eight inches by seven inches by one inch. Of course, the precise dimensions of the present invention are not critical to the invention so long as the functionality of the invention is maintained.

Top wall 22 preferably includes a plurality of taco shell receiving slots 28*a*, 28*b*, 28*c*, and 28*d*, each of which would have a length of approximately five to seven inches and a width of approximately one inch, although these dimensions may be modified as desired by the manufacturer of the present invention. The taco shell receiving slots 28*a–d* are designed to receive a taco shell 60 therein, as shown in FIG. 1, and the edges of the slot 28*a* engage the external surface of the taco shell 60, as shown in FIGS. 1 and 4 such that the taco shell 60 is supported in a generally upright position by the taco shell receiving slot 28*a*. Since the taco shell 60 is supported in the upright position by the slot 28*a*, both hands of the individual building the taco are available for adding the taco fillings 62, rendering it much less likely that spillage of the taco shell fillings will occur due to the availability of both hands. Once the taco shell 60 is filled, the taco may be quickly and easily removed from the slot 28*a* by simply lifting the taco shell 60 from the slot 28*a*. The plurality of slots 28*a–d* permit the simultaneous building of multiple tacos, which is a great convenience for the individual making the tacos. For example, if the individual building the tacos were a mother making tacos for her children, the simultaneous making of multiple tacos would allow each of the children to eat at the same time, rather than forcing the children to wait as a single taco is made at one time.

Of course, the taco shell support device 10 of the present invention requires an additional feature in order to properly secure the taco shell support device 10 in its upright taco shell support position. For this reason, the present invention provides a flap 26 hingedly connected to the top wall 22 and extending downwards therefrom, the hinged fold 27 connecting top wall 22 and flap 26 operating in much the same manner as described in connection with hinged folds 18 and 20. Foldably connected to flap 26 adjacent the free end thereof is a tab 30 which is operative to extend through a tab-receiving slot 32 formed in the second wall 16 adjacent base wall 12 and be releasably secured in the slot 32, as shown in FIGS. 1, 2 and 4. When the taco shell support device 10 is expanded from its flat storage position (shown in FIG. 5) to its upright taco shell support position (shown in FIGS. 1–4), foldable tab 30 is bent inwards towards the second wall 16 and extended through the tab-receiving slot 32 thereby securing the taco shell holder 10 of the present invention in its upright taco shell support position. The double wall formed by second wall 16 and flap 26 acts to prevent the taco shell support device 10 from pivoting about any of the hinged folds 18, 20, 24, and 27. If and when it is desired to collapse the taco shell support device 10 to its generally flat storage position, foldable tab 30 would be removed from slot 32 and the top wall 22 would be brought into contact with base wall 12 as hinged folds 18, 20, 24, and 27 are pivoted, as shown best in FIG. 5. It is in this generally flat storage position that the taco shell support device 10 of the present invention would be stored and likely sold as an element of a box of taco shells such as that commonly found in supermarkets and the like.

Once an individual purchased a box of taco shells, the individual would take the taco shells to his or her domicile, prepare the taco shells according to the instructions provided by the taco shell manufacturer and prepare the taco filling ingredients, such as meat, refried beans, lettuce, onions, etc. As the taco shells are being cooked, the taco shell support device 10 of the present invention would be removed from the taco shell box and expanded from its generally flat storage position to the upright taco shell support position. Foldable tab 30 would then be folded towards the interior of the box 50 and inserted into the tab-receiving slot 32 to support the box 50 in the upright taco shell support position. Once the taco shells are prepared the taco shells 60 would be inserted into the taco shell receiving slots 28*a–d*, each of which act to support the taco shells 60 in an upright position, and the preparer of the tacos would commence with the filling of the tacos. As each taco is prepared, it may be quickly and easily removed from the taco shell receiving slot 28*a–d* in which it is prepared and given to an individual for consumption. Once all of the taco shells have been consumed, the taco shell support device 10 of the present invention may be discarded or returned to its generally flat storage position for later use.

An important feature of the present invention deals with the preparation of the taco shells. As previously described, the taco shells could be prepared in the ordinary manner by heating the shells on their sides on a baking sheet. However, one major problem encountered in this type of preparation is that the taco shells often close during the cooking, thus rendering them unsuitable for use for tacos. The present invention provides a solution to this problem, as it is preferred that the taco shell support device 10 be constructed of a heavyweight paper that can be used in the cooking process itself. Generally, paper will not ignite until reaching over 450° Fahrenheit, and some types of impregnated paper have even higher ignition temperatures.

Therefore, the present invention contemplates the insertion of the taco shells 60 into the taco shell receiving slots 28*a–d* and then the maker of the shells would place the entire taco shell support device 10 in the oven and cook the taco shells 60 in the upright position. This position will generally eliminate the collapsing of the shells which renders them useless for tacos, along with decreasing the cooking time as the shell is completely exposed to the heat of the oven. Upon completion of the heating process, the shells 60 in the device 10 can be removed from the oven and the shell filling process can be begun almost immediately. The tacos can thus be served quicker and with less mess than was previously possible without the present invention.

Figure 6:
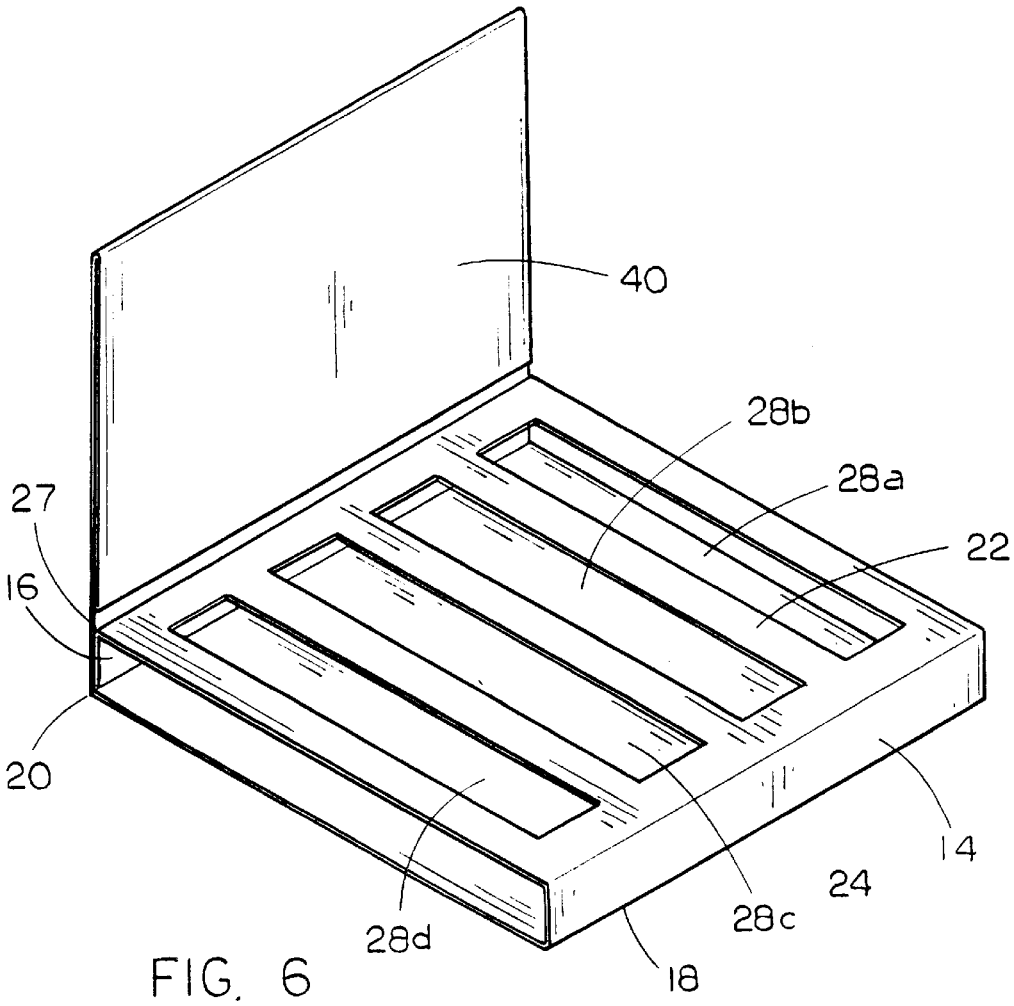
FIG. 6 is a perspective view of the present invention showing the box with the advertising placard mounted thereon.

It may be desirable to provide additional advertising space in connection with the present invention, particularly if the invention is used in the sale of fast food tacos or the like. The present invention thus provides an advertising placard 40 shown best in FIG. 6 which is mounted on the second wall 16 of the box 50. When the box 50 is in its generally flat storage position, the placard 40 also lays flat against the top wall 22 or could be folded the opposite direction so long as the box 50 lays generally flat. Upon the box 50 being expanded to its taco shell holding position, the placard 40 extends upwards behind the taco shells 60 being supported in the slots 28*a–d* and can be printed to display various types of advertising thereon. The placard 40 thus can provide a simple and vivid means of advertising for a business using or distributing the present invention. It also may be preferable to attach the flap connected to the top wall to the first wall by an adhesive or the like to provide additional securement for the box 50 in the taco shell holding position, as the version of the present invention with the placard 40 mounted thereon will ordinarily not be used in an oven during the cooking process.

Figure 7:
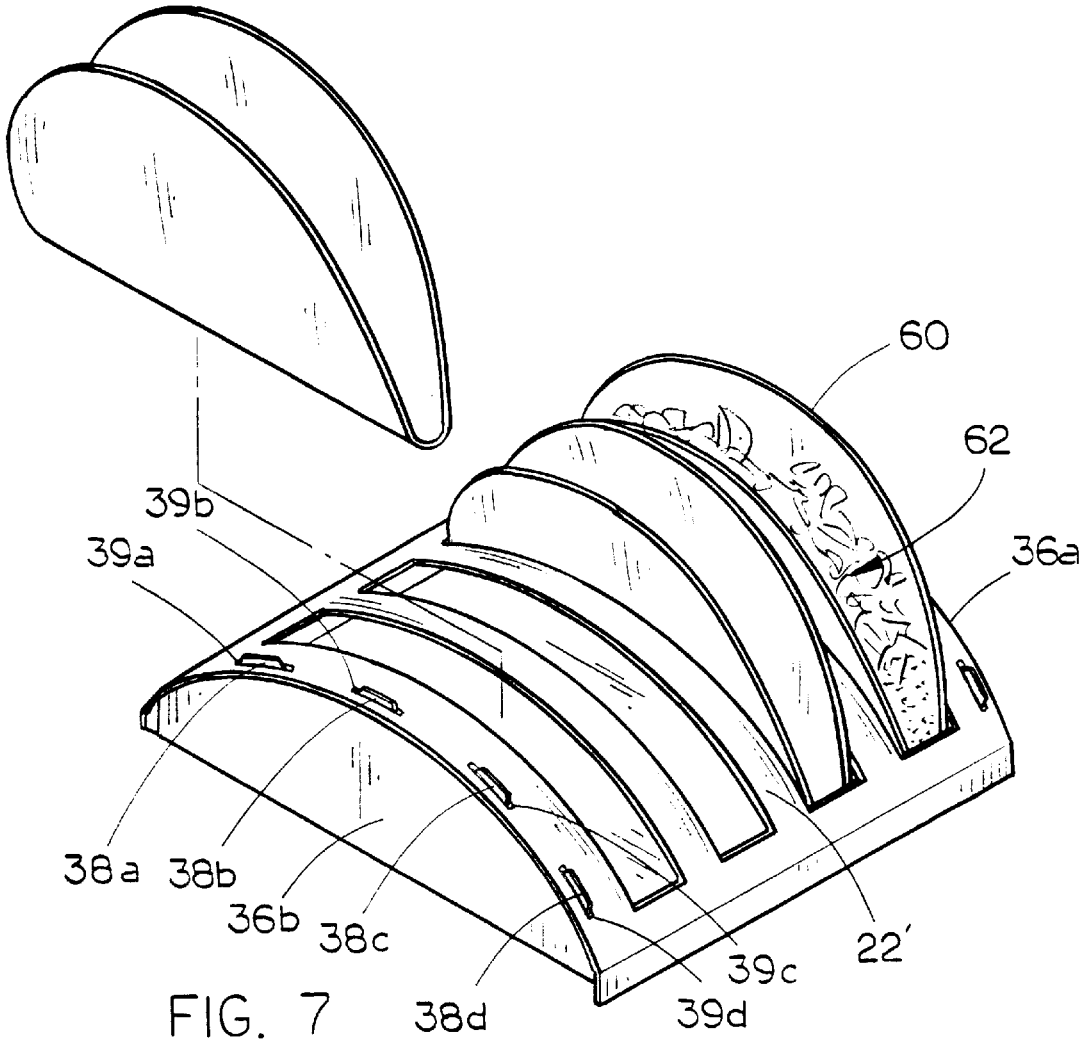
FIGS. 7 and 8 are perspective views of an alternative embodiment of the taco shell support device of the present invention having a curved top wall.
Figure 8:
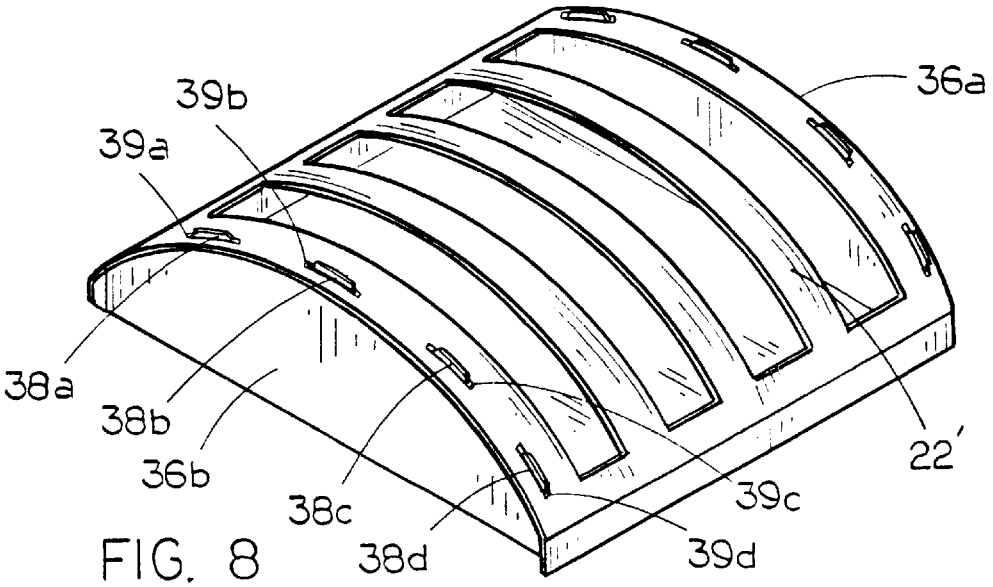

An alternative embodiment of the present invention is shown best in FIGS. 7 and 8 wherein top wall 22' is curved to provide additional support for a soft shell taco shell supported therein. Each of the slots 28*a–d* will be formed in the top wall 22' and would act to provide improved support for taco shell supported therein as the edges of each slot 28*a–d* would engage the taco shell at a point higher on the taco shell, thus increasing the stability of support for the taco shell. Side walls 36*a* and 36*b* would provide additional support for the curved top wall 22' with 38*a*, 38*b*, 38*c* and 38*d* on side wall 36*b* extending through slots 39*a*, 39*b*, 39*c* and 39*d* formed in top wall 22' to secure the side wall 36*b* to top wall 22'. Side wall 36*a* would be secured to the top wall 22' in the same manner.

FIG. 2 shows an alternative embodiment of the taco shell support device 10 of the present invention which includes first and second walls which are on the side of the box 50, but which function in the same manner as that described in connection with FIG. 1. FIG. 2 is intended to show that so long as the first and second walls are on opposite sides or ends of the box 50, the present invention will function correctly. Also, taco shell receiving slots 28*a–d* are shown as formed in a generally elongated oval shape which has been found to accommodate and support certain types of taco shells better than the standard rectangular shaped slots shown in FIG. 1. However, it is to be understood that the precise size and shape of the slots 28*a–d* is not critical to the present invention so long as the functionality of the invention is not impaired.

It is to be understood that numerous modifications, substitutions and additions may be made to the taco shell support device 10 of the present invention which falls within the intended broad scope of the appended claims. For example the size, shape and dimensions of the taco shell support 10 may be modified to accommodate various types of taco shells, so long as the intended functionality of the present invention is maintained. Furthermore, the number of slots formed in the top wall 22 of the present invention may be changed depending upon the number of taco shells which the device is intended to support. Finally, the construction material used to construct the taco shell support device 10 of the present invention may be modified so long as the functionality of the invention is not impaired.

There has thus been shown and described a taco shell support device which accomplishes at least all of the stated objectives.

I claim:

1. In combination:

at least one taco shell; and a taco shell support device comprising;

a collapsible, generally rectangular box having a base wall, opposite first and second walls hingedly mounted on said base wall and a top wall hingedly connected to one of said first and second walls such that said box is expandable from a generally flat storage position to an upright taco shell support position wherein said top wall is positioned above said base wall with said first and second walls spacing said top wall from said base wall; at least one taco-receiving slot formed in the top wall for receiving and supporting a taco shell; and a flap having flap securement means mounted thereon, said flap foldably connected to one of said base and top walls, said flap securement means operative to secure said flap to one of said first and second walls thereby securing said box in said upright taco shell support position.

2. The taco shell support device of claim 1 wherein said flap securement means comprises a tab foldably connected to said flap and extending therefrom, said tab operative to extend through and be releasably secured in a tab-receiving slot formed between said top and base walls in one of said first and second walls thereby securing said box in said upright taco shell support position.

3. The taco shell support device of claim 1 wherein said flap securement means comprises an adhesive applied to said flap for securing said flap to one of said first and second walls thereby securing said box in said upright taco shell support position.

4. The taco shell support device of claim 1 further comprising a generally flat, planar placard mounted on and extending upwards from one of said first and second walls, said placard extending above said top wall whereby said placard is operative to display advertising, printing and drawings thereon.

5. The taco shell support device of claim 1 comprising a plurality of taco-receiving slots formed in said top wall extending generally longitudinally parallel with one another.

6. The taco shell support device of claim 5 wherein said taco-receiving slots are generally rectangular in shape each having a length at least three times greater than the width of said slots.

7. The taco shell support device of claim 5 wherein said taco-receiving slots are generally elongated oval in shape each having a length at least three times greater than the width of said slots.

8. The taco shell support device of claim 1 wherein said device is constructed of an ovenable material whereby said device is capable of insertion into an oven for cooking of taco shells supported thereon.

9. A taco shell support device comprising:

a collapsible, generally rectangular box having a base wall, opposite first and second walls hingedly mounted on said base wall and a top wall hingedly connected to one of said first and second walls such that said box is expandable from a generally flat storage position to an upright taco shell support position wherein said top wall is positioned above said base wall with said first and second walls spacing said top wall from said base wall;

said top wall being convexly curved such that upon said taco shell support device being positioned in said upright taco shell support position, the center of said top wall is spaced further from said base wall than the ends of said top wall, said curved top wall operative to provide improved support for soft shell tacos;

at least one taco-receiving slot formed in the top wall for receiving and supporting a taco shell; and a flap having flap securement means mounted thereon, said flap foldably connected to one of said base and top walls, said flap securement means operative to secure said flap to one of said first and second walls thereby securing said box in said upright taco shell support position.

10. The taco shell support device of claim 9 further comprising side walls mounted on and extending upwards from said base wall on opposite sides thereof, said side walls operative to provide additional support for said curved top wall, each of said side walls including at least one upwardly extending wall projection, said top wall including at least two projection-receiving slot formed therein adjacent opposite sides thereof, said at least one wall projection extending through said at least one projection-receiving slot thereby securing said side walls to said curved top wall.

11. A taco shell support device comprising:

a collapsible, generally rectangular box having a base wall, opposite first and second walls hingedly mounted on said base wall and a top wall hingedly connected to one of said first and second walls such that said box is expandable from a generally flat storage position to an upright taco shell support position wherein said top wall is positioned above said base wall with said first and second walls spacing said top wall from said base wall;

at least one taco-receiving slot formed in the top wall for receiving and supporting a taco shell, said taco-receiving slot having a generally elongated oval shape for engaging and supporting the walls of a taco shell; and a flap having flap securement means mounted thereon, said flap foldably connected to one of said base and top walls, said flap securement means operative to secure said flap to one of said first and second walls thereby securing said box in said upright taco shell support position.

* * * * *